United States Patent [101]

Persik et al.

[11] 4,052,871

[45] Oct. 11, 1977

[54] STOCK-PIERCING PUNCH MECHANISM

[75] Inventors: James E. Persik; Gerald E. Persik, both of Menomonee Falls, Wis.

[73] Assignee: J. J. & M., Milwaukee, Wis.

[21] Appl. No.: 714,186

[22] Filed: Aug. 13, 1976

[51] Int. Cl.[2] ..... B21D 28/14

[52] U.S. Cl. ..... 72/44; 72/324; 83/633; 74/110

[58] Field of Search ..... 72/324, 325, 463, 41, 72/43, 44, 45, 334; 10/106; 83/169, 628, 633; 308/237 R, 237 A, 240, 3 A, 4 C, 5 R; 74/110

[56] References Cited

U.S. PATENT DOCUMENTS

| | | | |
|---|---|---|---|
| 1,242,239 | 10/1917 | Quigley | 308/240 |
| 1,995,548 | 3/1935 | Mermigis | 308/240 X |
| 2,163,090 | 6/1939 | Harry | 308/240 |
| 2,908,177 | 10/1959 | Powell | 308/5 R X |
| 2,962,074 | 11/1960 | Dupre et al. | 74/110 |
| 3,256,730 | 6/1966 | Faull | 72/324 |
| 3,478,629 | 11/1969 | Ek et al. | 83/169 |
| 3,602,081 | 8/1971 | Ballas | 83/169 X |
| 3,718,209 | 2/1973 | Moslo | 308/5 R X |
| 3,788,177 | 1/1974 | Williamson | 74/110 |
| 3,858,427 | 1/1975 | Euteneuer | 72/334 |
| 3,943,745 | 3/1976 | Paul | 72/335 |

*Primary Examiner*—Lowell A. Larson
*Attorney, Agent, or Firm*—Quarles & Brady

[57] ABSTRACT

In a stock-piercing punch mechanism which includes a base having a punch-receiving bore, a punch having a stock-piercing tip positioned for reciprocal movement in said bore, and a cam trigger pivotably mounted on said base which is adapted to receive a stock-piercing force from a press ram or the like to cause the trigger to pivot and to transmit the force to the punch to move the punch out of the bore to pierce properly positioned stock, the improvement which comprises, a lubrication reservoir located in the base adjacent the punch so that as the punch moves in the bore it picks up and distributes the lubricant to reduce frictional wear of the punch and the bore. In the preferred embodiment the punch is removably attached to a punch plate positioned within the punch mechanism so that the punch can be readily removed and replaced with other punches having the same or different shape and size stock-piercing tips.

1 Claim, 5 Drawing Figures

STOCK-PIERCING PUNCH MECHANISM

BACKGROUND OF THE INVENTION

It is well known that apertures can be formed in metal stock and similar materials by the use of presses and dies. However, the use of dies is relatively expensive and really only practical for comparatively long production runs. Of course, apertures can also be formed in such materials by drilling, but drilling requires a significant amount of energy and is time consuming. Of the other various methods of forming apertures in relatively thin metal stock, the most practical is that of piercing the stock with a punch. Piercing possesses distinct advantages over the other methods in that it is fast, inexpensive and requires a minimum expenditure of energy.

In the past there have been various attempts made to develop punch mechanisms which could be employed with conventional presses to convert the normal downward vertical stroke of the press ram into a nonvertical, angled or horizontal stock-piercing stroke. Representative of such devices is that shown in U.S. Pat. No. 3,256,730. Although such units are commercially available they are not completely satisfactory in part, because they do not have adequate lubrication systems to reduce frictional wear and to extend their useful life.

SUMMARY OF THE INVENTION

It is a general object of the present invention to disclose a punch mechanism which can be used with conventional presses and other force transmitting devices to deliver a nonvertical stock-piercing stroke, which mechanism has a superior lubrication system which reduces frictional wear of the components.

It is also an object to disclose a punch mechanism which allows the operator to readily change the size or shape of the stock-piercing tip of the punch so that a different size or shape aperture can be formed.

The stock-piercing punch mechanism of the present invention includes a base having a punch-receiving bore, a punch having a stock-piercing tip positioned for reciprocal movement in said bore, a cam trigger pivotably mounted on said base which is adapted to receive a stock-piercing force from a press ram or the like to cause the trigger to pivot or rotate and to transmit the force to the punch to move the punch out of its bore to pierce properly positioned stock and a lubrication reservoir located in the base adjacent the punch so that as the punch moves in the bore it picks up and spreads the lubricant to reduce frictional wear upon the punch and the bore thereby extending the life of the components.

In the preferred embodiment, the punch is removably attached to a punch pin positioned within the punch mechanism and the punch can be readily replaced with other punches having the same or different shape or size stock-piercing tips.

These and other objects of the invention will be apparent from the specification which follows.

DESCRIPTION OF THE PREFERRED EMBODIMENT

Figure 1:
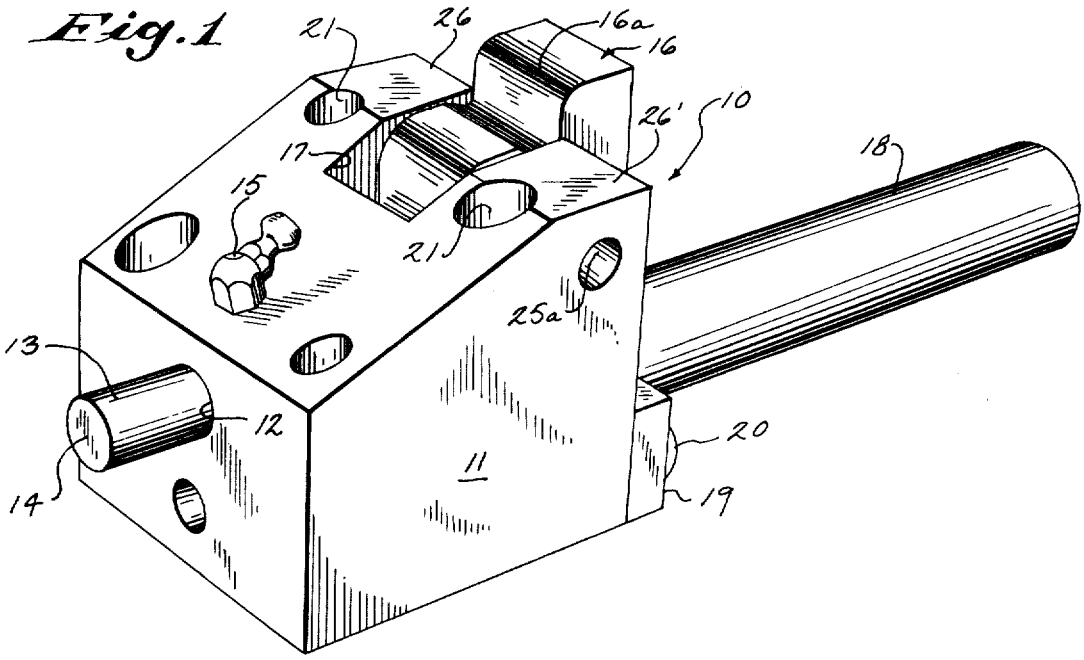
FIG. 1 is a perspective view of the preferred embodiment of the invention.

In the drawings, the punch mechanism is generally referred to by the number 10. As seen in FIG. 1 of the drawings, the punch mechanism 10 has a base 11 which is provided at one end with a punch-receiving bore 12 in which a punch 13 having a stock-piercing tip 14 is positioned. As seen in the drawings, the mechanism 10 is also provided with a lubrication fitting 15, a cam trigger 16, a trigger receiving slot 17, a protective spring cover 18, a strap plate 19, strap plate screws 20, and orientation apertures 21.

Figure 2:
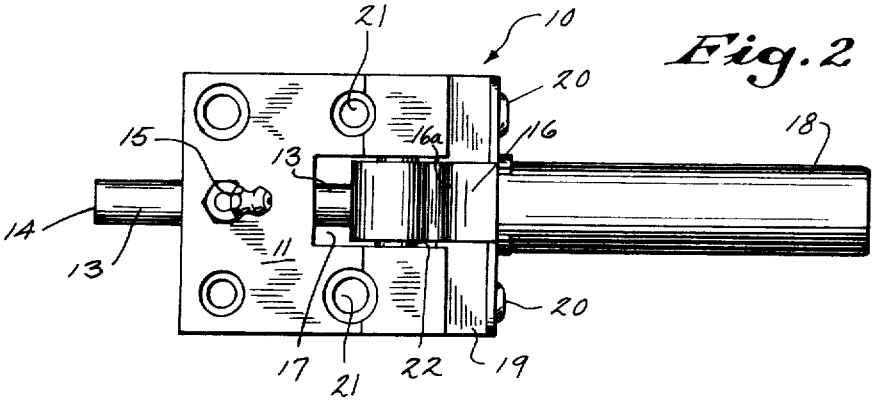
FIG. 2 is a top elevational view of the preferred embodiment.
Figure 5:
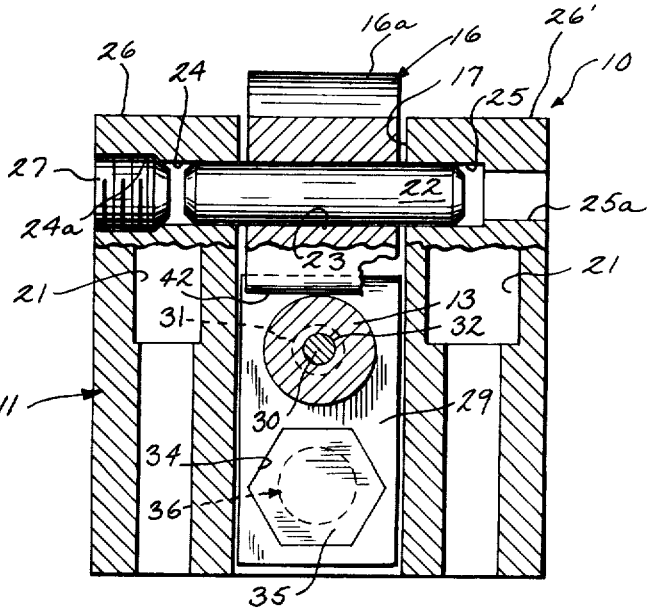
FIG. 5 is a sectional view taken along lines 5-5 of FIG. 3.

As seen in FIGS. 2 and 5, the trigger 16 is retained in position for pivotal movement in the trigger-receiving slot 17 by a pivot pin 22. As seen in FIG. 5, the pivot pin 22 passes through a pivot pin aperture 23 in the trigger 16 and aligned pivot pin receiving bores 24, 25 in the arms 26, 26' on each side of the slot 17. The pivot pin 22 is retained in position by a pivot pin screw 27 received in an internal threaded portion **24*a* of the bore 24 and an internal shoulder 25*a* in the bore 25**.

Figure 3:
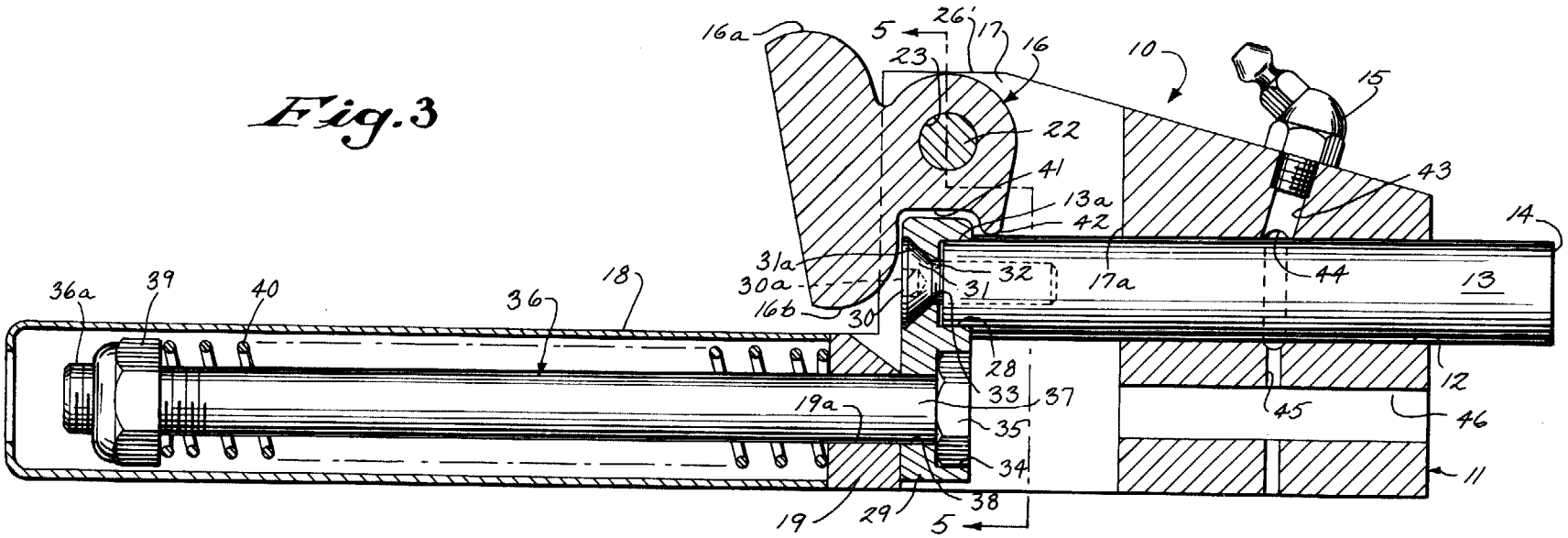
FIG. 3 is an enlarged sectional view of the preferred embodiment showing the components of the device at rest.
Figure 4:
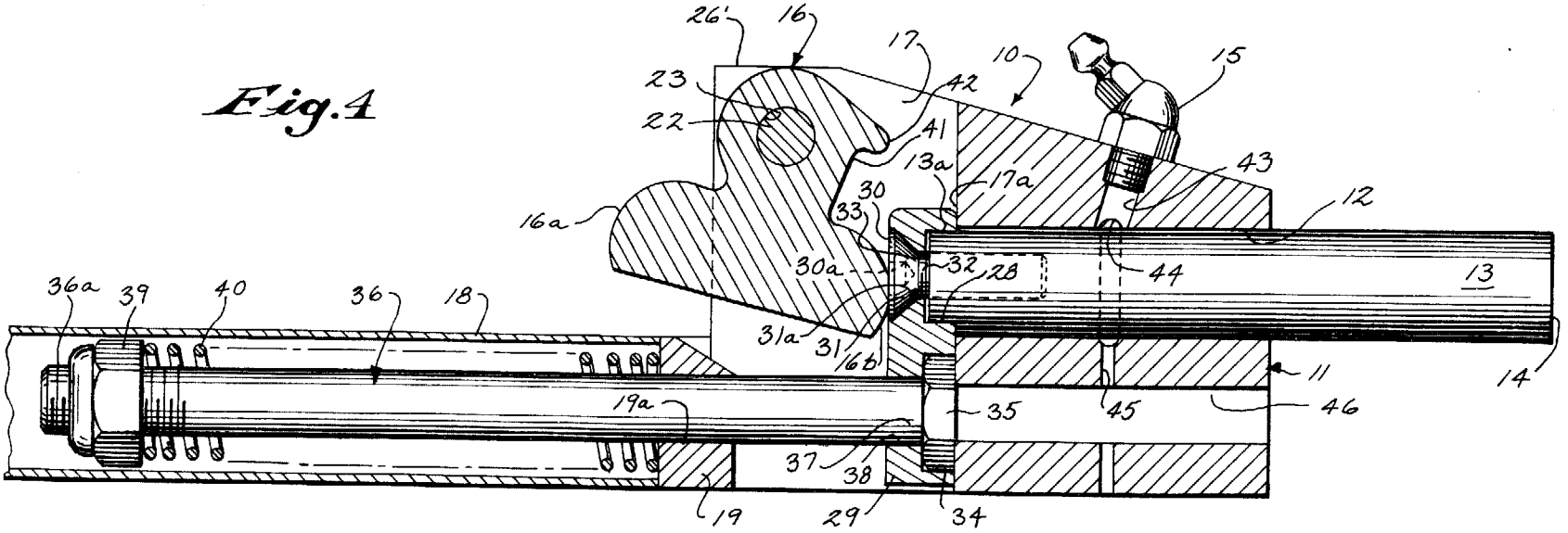
FIG. 4 is an enlarged sectional view of the preferred embodiment showing the components of the device in the position they assume when a stock-piercing force is exerted upon the trigger.

Turning now to FIGS. 3 and 4 in which the punch mechanism is seen in section, it can be seen that the end **13*a* of the punch 13 opposite the stock-piercing tip 14 is received in a recess 28 in a punch plate 29. The end 13*a* of the punch 13 is internally threaded and is retained in the recess 28 by a punch pin 30 which is threadably connected to the punch 13. The punch pin 30 is provided with an enlarged head 31 which is received in a matching recess 31*a* in the plate 29. The threaded shaft 32 of the punch plate 29. As seen in the drawings, the punch plate 29 is further provided with another recess 34 in which the head 35 of a spring rod 36 is positioned. The shaft 37 of the spring rod 36 extends through an aperture 38 in the punch plate 29 and an opening 19*a* in the strap plate 19. Positioned upon the threaded other end 36*a* of the spring rod 36 is a hex nut 39 and positioned axially about the spring rod 36 between the strap plate 19 and the hex nut 39 is a helical compressive spring 40. The end 36*a* of the spring rod 36, the hex nut 39 and the spring 40 are positioned within the protective spring cover 18 which is secured to the strap plate 19 by the screws 20**.

Still referring to FIGS. 3 and 4, it can be seen that the cam trigger 16 is provided with an upper convex working surface **16*a* and a lower convex working surface 16*b*. In addition, the trigger 16 is provided adjacent the lower convex working surface 16*b* with a punch plate receiving recess 41 and a radially projecting stop 42. As can also be seen in those figures of the drawings, the base 11 is provided with a passage 43 leading from the lubrication fitting 15 to an annular groove 44 win the punch-receiving bore 12. Leading from the annular groove 44 is an exit passage 45 which leads to a spent lubricant collection passage 46 which opens both the outside of the base 11, as seen in FIG. 1, and into the trigger-receiving slot 17**.

In operation the punch mechanism 10 is positioned upon the bed of a press (not shown) and secured to the bed by pins or dowels extending through the orientation apertures 21. The stock-piercing tip 14 of the punch 13 is positioned adjacent the material to be pierced, and preferably a stock supporting member (not shown) having a corresponding size and shaped aperture aligned with the stock-piercing tip 14 is located on the opposite side of the stock material. When the press is activated, the ram of the press or preferably a hex bolt extension of the ram contacts and exerts a force on the upper convex surface 16a of the trigger 16 causing the trigger 16 to pivot or rotate about the pivot pin 22 to the position seen in FIG. 4. As the trigger 16 rotates, the punch plate receiving recess 41 and the stop 42 are swung up and away from punch plate 29. When the trigger 16 rotates, the lower convex surface 16b of the trigger 16 contacts the head 31 of the punch pin 31 and transmits the force from the press to the punch plate 29 moving it transversely until it comes to rest against the end 17a of the slot 17. As the punch plate 29 moves transversely, the spring rod 36 is also moved causing the spring 40 to be compressed between the hex nut 39 and the strap plate 19 and the punch 13 is moved out of its bore 12 to pierce the stock. Once the force on surface 16a of the trigger 16 is relieved, the compressed spring 40 returns the punch plate 29, the punch 13 and the trigger 16 to their original position seen in FIG. 3 and the operation is complete. If desired, an annular stripper can be provided, as seen in broken lines in FIGS. 3 and 4, to insure that none of the material severed from the stock adheres to the punch 13.

As the punch 13 reciprocates within the bore 12, lubricant is picked up by the punch 13 and distributed from a lubricant reservoir which in the preferred embodiment shown in the drawings is the annular groove 44 about the bore 12. The lubricant is deposited between the outer surface of the punch 13 and the interior surface of the bore 12 thus reducing the frictinal wear and tear on the punch 13 and the bore 12.

In the preferred practice, fresh lubricant is introduced into the punch mechanism 10 via the lubrication fitting 15 which is connected by the passage 43 to the annular groove 44 and the spent lubricant leaves the annular groove 44 via the passage 45 which leads to the spent lubricant collection chamber 46 which leads to the outside of the base 11 and to the inner wall of the slot 17. A small amount of spent lubricant may also leave the mechanism via the bore 12.

It will be readily apparent to those skilled in the art that stroke of the press ram or the hex bolt extension thereof must be adjusted so that the force on the trigger 16 is relieved when the punch plate 29 has traveled its maximum distance in the slot 17 otherwise the trigger 16 would be fractured. The use of a hex bolt extension of the press ram is especially preferred because it facilitates such adjustment.

In actual practice, a significant amount of grease or lubricant is applied to the upper convex surface 16a of the trigger and as a result on occasion an oil seal or hydraulic type seal can develop between the punch ram or the hex bolt extension of the ram and the upper convex surface 16a of the trigger 16. As a result of the seal there is a tendency for the ram or hex bolt to carry the trigger 16 back past its proper initial position seen in FIG. 3. To prevent this from happening, the radially extending stop 42 is provided on the trigger 16 from being carried too far by breaking any seal that may exist. Thus, the stop 42 insures that the trigger 16 of the punch mechanism shall always be properly aligned to receive a complete stock-piercing stroke.

In the preferred embodiment shown in the drawings, the shape of the aperture or the size of the aperture which is to be pierced in the stock may be readily changed by replacing the original punch 13 with a new punch having the desired shaped stock-piercing point. The old punch is easily replaced by removing the pivot pin screw 27 and removing the pivot pin from the aperture 23 in the trigger 16 and the bores 24, 25 in the arms 26 and 26'. The trigger 16 is then removed and the old punch is removed by anchoring the punch pin 30 by inserting a suitable shaped and sized hex wrench or screwdriver into a recess 30a in the head of the punch pin 30 and unthreading the punch 13 therefrom. The old punch 13 is then withdrawn from the bore 12 and the threaded end 13a of the new punch 13 inserted in the bore 12 and threaded into connection with the punch pin 30. The trigger 16 is then replaced by reversing the previously described process and the mechanism is ready for use. Normally these operations can be performed while the base of the punch mechanism is securely fastened to the press bed. However, in some instances, the mechanism may have to be unfastened to change the punch 13.

The use of the punch pin 30 to anchor the punch 13 to the punch plate 29 not only makes it relatively simple to replace the punch but it also makes it possible to use punches having larger stock-piercing tips than can be acccommodated by the bore 12.

The preferred embodiment of the punch mechanism can be used to form apertures ranging from less than 0.125 to greater than 0.625 inches in diameter in mild steel, aluminum, brass, copper and even stainles steel stock ranging in thickness up to 0.250 inch. The only limitations on the size opening that can be pierced are the strength of the various components and the punching force exerted on the trigger by a press or similar device. Depending upon the nature of the material being pierced, the preferred mechanism can be used without a stripper, with the stripper shown in the drawing or with conventional solid strippers. In all such applications the superior lubrication system not only prolongs the useful life of the punch and bore but also reduces the energy required to operate the mechanism thereby minimizing friction.

Although for purposes of illustration the invention has been described in regard to a specific embodiment it will be readily apparrent that the invention is not so limited. For example, the novel lubrication system may be employed with a wide variety of known punch mechanisms including those provided with an inboard spring in which case the spent lubricant can be collected in the inboard spring chamber in the base. In addition, the various components may be of different shapes or sizes than described as long as they perform their described functions. Therefore, it is to be understood that such changes and modifications can be made without departing from the spirit and scope of the invention.

We claim:

1. A stock-piercing punch mechanism for converting the vertical stroke of a press ram into a nonvertical stock-piercing stroke, which punch mechanism includes:

a. a base member provided with a cam trigger-receiving slot and a stock-piercing punch-receiving bore;

b. a punch assembly including a punch plate and an elongated punch member having a stock-piercing tip at its outer end positioned in said bore for reciprocal movement; said punch member being removably connected at its inner end to the punch plate so that the elongated punch member having the stock-piercing tip can be replaced without completely disassemblying the punch mechanism;

c. a cam trigger pivotably mounted in the cam triggerreceiving slot in said member, said trigger having a first convex surface which is adapted to receive a stock-piercing force from a press ram to cause the trigger to pivot and a second convex surface which as the trigger pivots in response to the stock-piercing force transmits that force to the punch plate so as to move the punch member partially out of the bore to a stock-piercing position, said cam trigger being further provided with a radially extending stop member which contacts the punch member and limits the extent of the movement of the trigger when the stock-piercing force is relieved so that when the punch member returns to its original position in the bore the trigger is properly aligned to receive a stock-piercing force;

d. compression spring means which restore the punch and the cam trigger to their original position upon relief of the stock-piercing force; and e. lubrication means which include a lubricant reservoir consisting of an annular groove in the base member which is located intermediate the length of said bore and surrounds the outside of the punch member, said lubrication means further including a first passage leading from the outside of the base member to the groove so that lubricant can be introduced through said passage into said groove and a second passage leading from the groove so that lubricant can leave the groove, said groove being adapted to receive and hold lubricant so that the movement of the punch member within the bore will pick up and distribute lubricant from said groove along the outer surface of the punch member and the interior surface of the bore so as to reduce frictional wear.

* * * * *